US008224658B2

(12) United States Patent
Lei et al.

(10) Patent No.: US 8,224,658 B2
(45) Date of Patent: Jul. 17, 2012

(54) METHOD, MEDIUM, AND APPARATUS ENCODING AND/OR DECODING AN AUDIO SIGNAL

(75) Inventors: Miao Lei, Yongin-si (KR); Eun-mi Oh, Yongin-si (KR); Jung-hoe Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1469 days.

(21) Appl. No.: 11/634,251

(22) Filed: Dec. 6, 2006

(65) Prior Publication Data

US 2007/0127580 A1 Jun. 7, 2007

Related U.S. Application Data

(60) Provisional application No. 60/742,886, filed on Dec. 7, 2005.

(30) Foreign Application Priority Data

May 30, 2006 (KR) ..... 10-2006-0049043

(51) Int. Cl.
*G10L 19/00* (2006.01)

(52) U.S. Cl. ..... 704/500; 703/230; 703/200; 703/501; 703/503; 703/504

(58) Field of Classification Search ..... 704/230, 704/500, 501, 200, 503, 504
See application file for complete search history.

(56) References Cited

U.S. PATENT DOCUMENTS

| | | | | |
|---|---|---|---|---|
| 6,317,520 | B1 * | 11/2001 | Passaggio et al. | 382/238 |
| 2002/0027516 | A1 | 3/2002 | Yip | |
| 2003/0187634 | A1 * | 10/2003 | Li | 704/200.1 |
| 2004/0181394 | A1 | 9/2004 | Kim et al. | |
| 2005/0008231 | A1 | 1/2005 | Christopoulos et al. | |
| 2005/0203731 | A1 | 9/2005 | Oh et al. | |
| 2006/0238386 | A1 * | 10/2006 | Huang et al. | 341/50 |
| 2007/0040710 | A1 * | 2/2007 | Tomic | 341/50 |
| 2008/0094259 | A1 * | 4/2008 | Yu et al. | 341/51 |

FOREIGN PATENT DOCUMENTS

| | | |
|---|---|---|
| JP | 2001-517905 | 9/2001 |
| JP | 2002-159009 | 5/2002 |
| JP | 2002-368625 | 12/2002 |
| JP | 2004-040372 | 2/2004 |
| JP | 2004-199064 | * 7/2004 |
| JP | 2005-260969 | 9/2005 |
| WO | 99/16250 | 4/1999 |

OTHER PUBLICATIONS

Hu et al. ,"AVS generic Audio Coding", proceeding of the sixth international conference, PDCAT, Dec. 5-8, 2005.*
Park et al. "Multi-layer bit-sliced bit-rate scalable audio coder," 103 rd AES convention preprint 4520, 1997.*

(Continued)

*Primary Examiner* — Qi Han
(74) *Attorney, Agent, or Firm* — Staas & Halsey LLP

(57) ABSTRACT

A method, medium, and apparatus encoding and/or decoding an audio signal. The method of encoding an audio signal includes transforming an input audio signal into an audio signal in a frequency domain, quantizing the frequency-domain transformed audio signal, and performing bitplane coding on the quantized audio signal using a context that represents various available symbols of an upper bitplane.

25 Claims, 7 Drawing Sheets

OTHER PUBLICATIONS

Miao et al. "Context-dependent bitplane coding in China AVS audio", IEEE, 2005.*

Qiu, Tong, "Lossless Audio Coding Based on High Order Context Modeling", Multimedia Signal Processing, 2001 IEEE Fourth Workshop on Oct. 3-5, 2001, Piscataway, NJ, USA, IEEE, Oct. 3, 2001, pp. 575-580.

Extended European Search Report issued Apr. 13, 2010, corresponds to European Patent Application No. 06823935.9-2225.

International Search Report mailed Mar. 6, 2007, corresponds to International Application No. PCT/KR2006/005228.

Lei, Miao et al., "Context-dependent Bitplane Coding, Quantization Entropy Coding Module (CBC)" Beijing Samsung Communications Tec. Research Co. Ltd., China AVS M1368, Beijing, Aug. 2004.

Lei, Miao et al., "Context-dependent Bitplane Coding (CBC) the Conclusion of Encoding Efficiency Experiment", Beijingsamsung Communication Tech TechniqueLtd., Samsung Synthesis Technique Institute, China AVS M1433, Beijing, Oct. 2004.

Japanese Office Action issued on Jan. 18, 2011, corresponds to Japanese Patent Application No. 2008-544254.

Japanese Non Final Rejection Office Action dated May 31, 2011, corresponds to Japanese Patent Application No. 2008-544254.

* cited by examiner

FIG. 6

PROCESS 1 int cb_tab[16] = {0,1,2,3,4,5,6,7,8,9,10,7,11,7,7,7};

0111/1011/1101/1110/1111
THREE "1"S OR MORE

PROCESS 2 int cb_tab[16] = {0,1,2,3,4,3,3,5,6,3,3,5,3,5,5,5};

TWO "1"S
0011/0101/ 0110/1001/ 1010/1100

0111/1011/1101/1110/1111
THREE "1"S OR MORE

FIG. 7

```
cbc_layer_spectra()
for (snf = maxsnf; snf > thr_snf; snf--) {
    maxhalf = 1 << (snf-1);
for (g = start_g; g < end_g; g++) {
for (i = start_index[g]; i < end_index[g]; i++)
    for (ch = 0; ch < nch; ch++) {
        if (cur_snf[ch][g][i] < snf) continue;
        if (!sample[ch][g][i] || sign_is_coded[ch] [g][i]) {
            model_select();
            upper_vector_mapping();
            data_huffman_decoding();
        }
        if (sample[ch][g][i] && !sign_is_coded[ch] [g][i]) {
            if (!layer_data_available()) return;
            sign_Huffman_decoding();
            sign_is_coded[ch][g][i] = 1;
        }
        cur_snf[ch][g][i]--;
        if (!layer_data_available()) return;
    }
}
}
```

METHOD, MEDIUM, AND APPARATUS ENCODING AND/OR DECODING AN AUDIO SIGNAL

CROSS-REFERENCE TO RELATED APPLICATIONS

This application claims the benefit of U.S. Provisional Patent Application No. 60/742,886, filed on Dec. 7, 2005, in the US Patent and Trademark Office, and the benefit of Korean Patent Application No. 10-2006-0049043, filed on May 30, 2006, in the Korean Intellectual Property Office, the disclosures of which are incorporated herein in their entirety by reference.

BACKGROUND

1. Field of the Invention

One or more embodiments of the present invention relate to an encoding and/or decoding of an audio signal, and more particularly, to a method, medium, and apparatus encoding and/or decoding an audio signal for minimization of the size of codebooks used in encoding or decoding of audio data.

2. Description of the Related Art

As digital signal processing technologies advance, most audio signals are being stored and played back as digital data. Digital audio storage and/or playback devices sample and quantize analog audio signals, transform the analog audio signals into pulse code modulation (PCM) audio data, which is a digital signal, and store the PCM audio data in an information storage medium, such as a compact disc (CD), a digital versatile disc (DVD), or the like, so that a user can reproduce the stored audio data from the information storage medium when he/she desires. Digital audio signal storage and/or reproduction techniques have considerably improved sound quality and remarkably reduced the deterioration of sound caused by long storage periods, compared to analog audio signal storage and/or reproduction methods, such as conventional long-play (LP) records, magnetic tapes, or the like. However, this has also resulted in large amounts of digital audio data, which sometimes poses a problem for storage and transmission.

In order to solve these problems, a wide variety of compression techniques have been implemented for reducing/compressing the digital audio data so more audio data can be stored or the stored audio data takes up less recording space. Moving Picture Expert Group audio standards, drafted by the International Standard Organization (ISO), and AC-2/AC-3 technologies, developed by Dolby, have adopted techniques for reducing/compressing the size of the audio data using psychoacoustic models, which results in an effective reduction in the size of the audio data regardless of the individual characteristics of underlying audio signals.

Conventionally, for entropy encoding and decoding during encoding of a transformed and quantized audio signal, context-based encoding and decoding have been used. To this end, these conventional techniques require a corresponding codebook for the context-based encoding and decoding, which requires a large amount of memory.

SUMMARY

Accordingly, one or more embodiments of the present invention provides a method, medium, and apparatus encoding and/or decoding an audio signal, in which efficiency in encoding and decoding can be improved while minimizing the size of codebooks.

Additional aspects and/or advantages of the invention will be set forth in part in the description which follows and, in part, will be apparent from the description, or may be learned by practice of the invention.

According to the above and/or other aspects and advantages, embodiments of the present invention may include a method of encoding an audio signal, the method including transforming an audio signal into a frequency-domain audio signal, quantizing the frequency-domain audio signal, and performing bitplane coding on a current bitplane of the quantized audio signal using a context representing various available symbols of an upper bitplane.

According to the above and/or other aspects and advantages, embodiments of the present invention may include at least one medium including computer readable code to control at least one processing element to implement an embodiment of the present invention.

According to the above and/or other aspects and advantages, embodiments of the present invention may include a method of decoding an audio signal, the method including decoding an encoded current bitplane of a bitplane encoded audio signal using a context that is determined to represent various available symbols of an upper bitplane, inversely quantizing a corresponding decoded audio signal, and inversely transforming the inversely quantized audio signal.

According to the above and/or other aspects and advantages, embodiments of the present invention may include an apparatus for encoding an audio signal, the apparatus including a transformation unit to transform an audio signal into a frequency-domain audio signal, a quantization unit to quantize the frequency-domain audio signal, and an encoding unit to perform bitplane coding on a current bitplane of the quantized audio signal using a context representing various available symbols of an upper bitplane.

According to the above and/or other aspects and advantages, embodiments of the present invention may include at least one medium including audio data with frequency based compression, with separately bitplane encoded frequency based encoded samples including respective additional information controlling decoding of the separately encoded frequency based encoded samples based upon a respective context in the respective additional information representing various available symbols for an upper bitplane other than a current bitplane.

According to the above and/or other aspects and advantages, embodiments of the present invention may include an apparatus for decoding an audio signal, the apparatus including a decoding unit to decode an encoded current bitplane of a bitplane encoded audio signal using a context that is determined to represent various available symbols of an upper bitplane, an inverse quantization unit inversely quantizing the decoded audio signal, and an inverse transformation unit inversely transforming the inversely quantized audio signal.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 6 illustrates a process explaining an operation of determining a context, such as discussed regarding FIG. 4, according to an embodiment of the present invention;

FIG. 7 illustrates a pseudo code for Huffman coding with respect to an audio signal, according to an embodiment of the present invention;

DETAILED DESCRIPTION OF EMBODIMENTS

Figure 1:
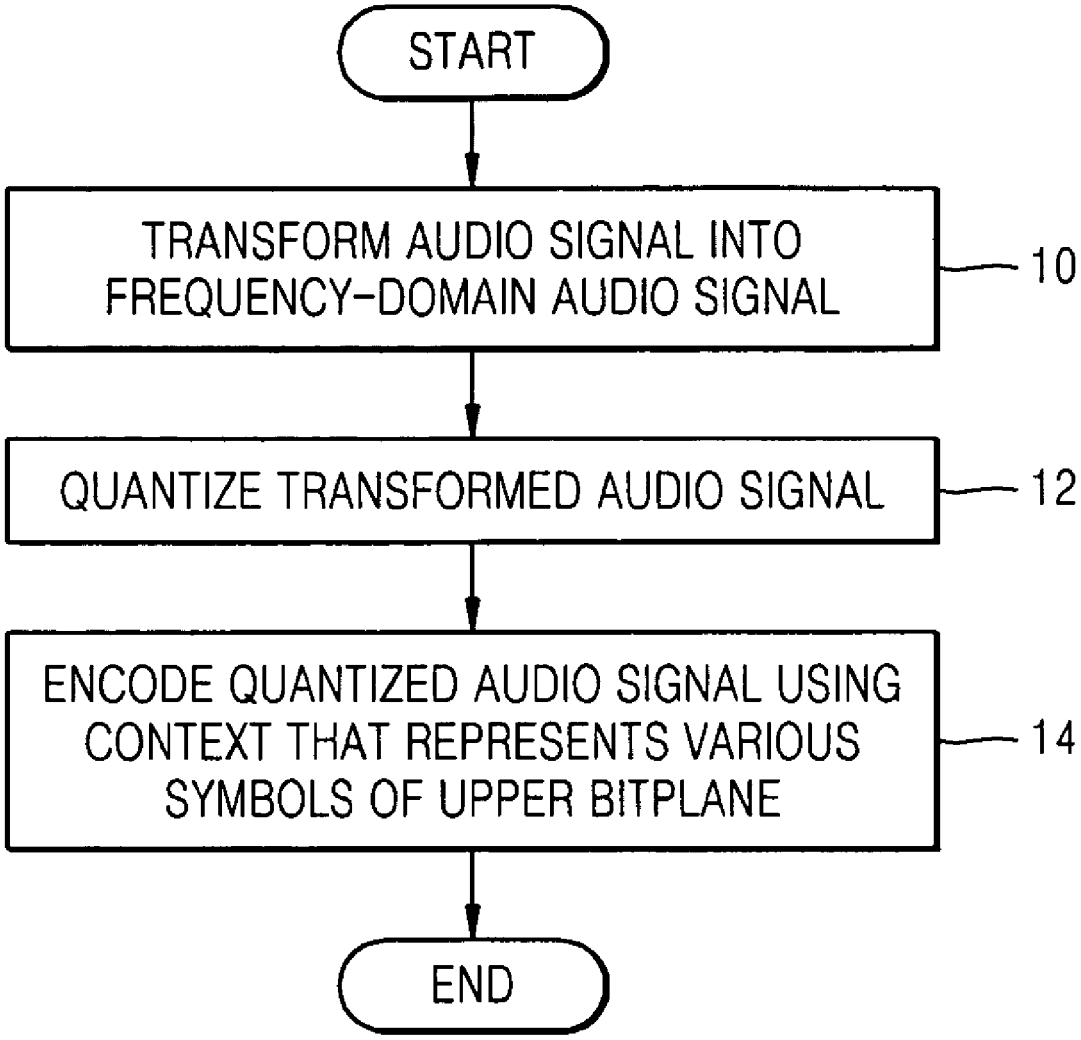
FIG. 1 illustrates a method of encoding an audio signal, according to an embodiment of the present invention.

Reference will now be made in detail to embodiments of the present invention, examples of which are illustrated in the accompanying drawings, wherein like reference numerals refer to the like elements throughout. Embodiments are described below to explain the present invention by referring to the figures.

FIG. 1 illustrating a method of encoding an audio signal, according to an embodiment of the present invention.

Referring to FIG. 1, an input audio signal may be transformed into the frequency domain, in operation 10. For example, pulse code modulated (PCM) audio data, which is an audio signal in a time domain, may be input and then transformed into the frequency domain, e.g., with reference to information regarding a psychoacoustic model. Characteristics of perceptual audio signals that can be perceived do not differ much in the time domain. In contrast, characteristics of perceptual and unperceptual audio signals in the frequency domain differ substantially considering the psychoacoustic model. Thus, compression efficiency can be improved by assigning a different number of bits to each frequency band. Accordingly, here, in one embodiment of the present invention, a modified discrete cosine transform (MDCT) may be used to transform the audio signal into the frequency domain.

The resultant frequency domain audio signal may then be quantized, in operation 12. The audio signals in each band may be scalar-quantized, as quantized samples, based on corresponding scale vector information to reduce quantization noise intensity in each band to be less than a masking threshold so that quantization noise cannot be perceived.

The quantized audio signal samples may then be encoded using bitplane coding, where a context representing various symbols of an upper bitplane is used. According to one embodiment, quantized samples belonging to each layer are encoded using bitplane coding.

Figure 2:
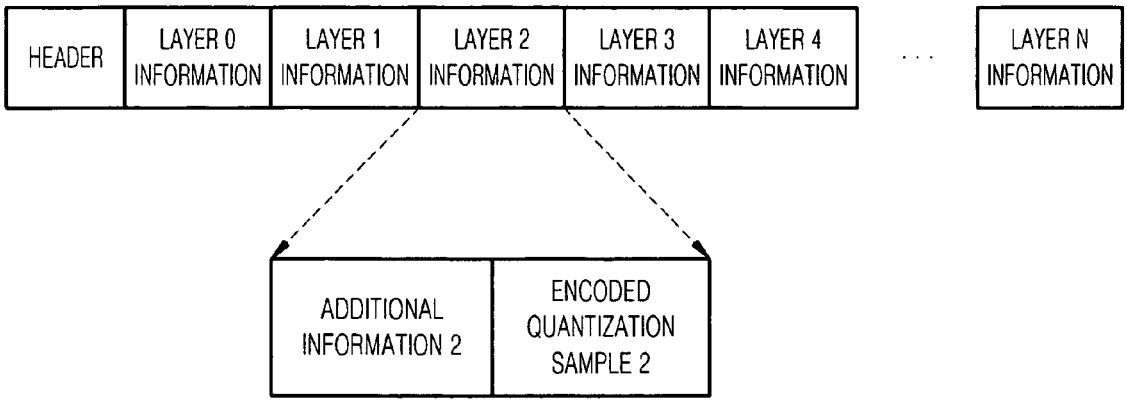
FIG. 2 illustrates a frame of a bitstream encoded into a hierarchical structure, according to an embodiment of the present invention.

FIG. 2 illustrates a frame of a bitstream encoded into a hierarchical structure, according to an embodiment of the present invention. Referring to FIG. 2, the frame of the bitstream is encoded by mapping quantized samples and additional information into a hierarchical structure. In other words, the frame has a hierarchical structure in which a bitstream of a lower layer and a bitstream of a higher layer are included. Additional information necessary for each layer may be encoded on a layer-by-layer basis.

As shown in FIG. 2, a header area storing header information may be located at the beginning of a bitstream, followed by information of layer 0, and followed by respective additional information and encoded audio data information of each of layers 1 through N. For example, additional information 2 and encoded quantized samples 2 may be stored as information of layer 2. Here, N is an integer that is greater than or equal to 1.

Figure 3:
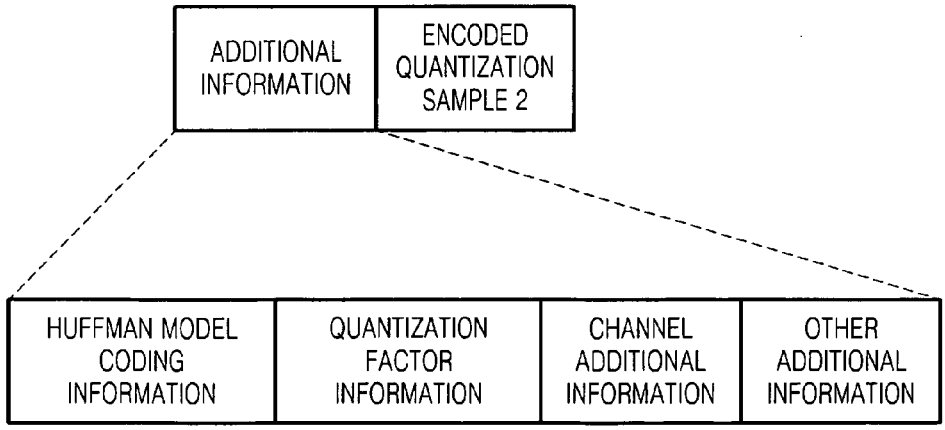
FIG. 3 illustrates additional information, such as illustrated in FIG. 2, according to an embodiment of the present invention.

FIG. 3 illustrates additional information, such as that illustrated in FIG. 2, according to an embodiment of the present invention. Referring to FIG. 3, additional information and encoded quantized samples of an arbitrary layer may be stored as information. In this embodiment, additional information contains Huffman coding model information, quantization factor information, channel additional information, and other additional information. Here, huffman coding model information refers to index information of a Huffman coding model to be used for encoding or decoding quantized samples contained in a corresponding layer, the quantization factor information informs a corresponding layer of a quantization step size for quantizing or dequantizing audio data contained in the corresponding layer, the channel additional information refers to information on a channel such as middle/side (M/S) stereo, and the other additional information is flag information indicating whether the M/S stereo is used, for example.

Figure 4:
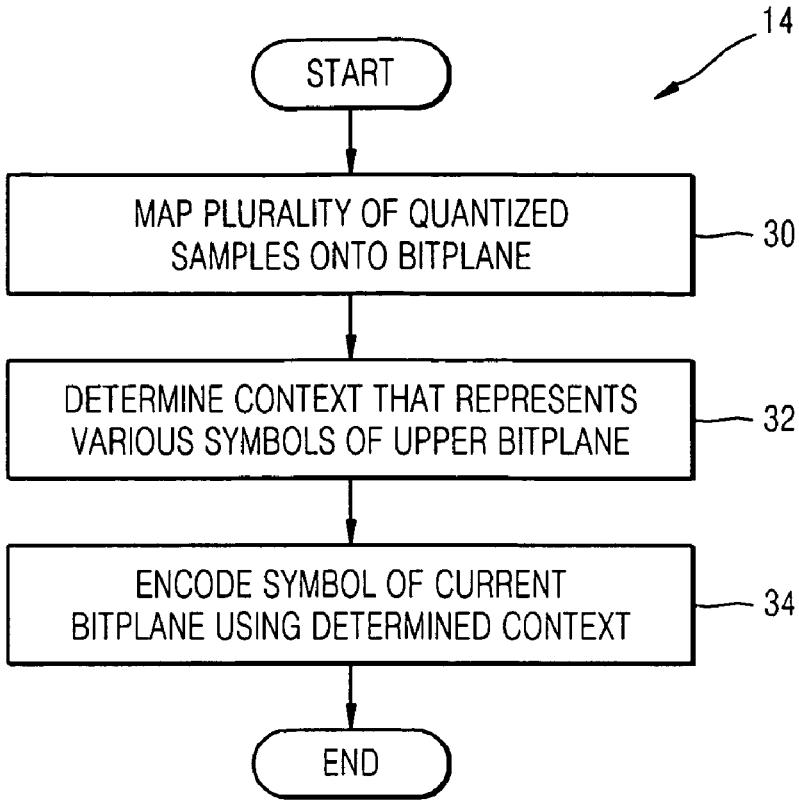
FIG. 4 illustrates an operation of encoding a quantized audio signal, such as illustrated in FIG. 1, according to an embodiment of the present invention.

FIG. 4 illustrates an operation of encoding a quantized audio signal, such as operation 14 illustrated in FIG. 1, according to an embodiment of the present invention.

In operation 30, a plurality of quantized samples of the quantized audio signal may be mapped onto a bitplane. The plurality of quantized samples are expressed as binary data by being mapped onto the bitplane and the binary data is encoded in units of symbols within a bit range allowed in a layer corresponding to the quantized samples, in an order from a symbol formed with most significant bits to a symbol formed with least significant bits, for example. By first encoding signification information and then encoding relatively less significant information in the bitplane, a bitrate and a frequency band corresponding to each layer may be fixed, thereby reducing a potential distortion called the "Birdy effect".

Figure 5:
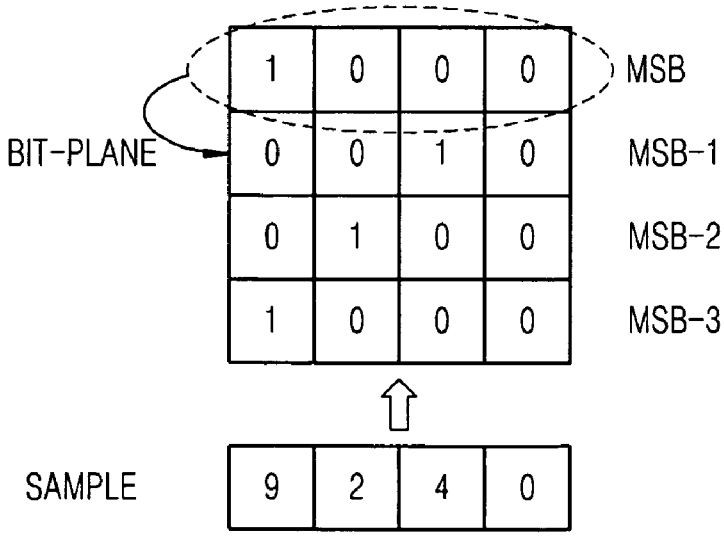
FIG. 5 illustrates an operation of mapping a plurality of quantized samples onto a bitplane, such as discussed regarding FIG. 4, according to an embodiment of the present invention.

FIG. 5 illustrates an operation of mapping a plurality of quantized samples onto a bitplane, such as with operation 30 of FIG. 4, according to an embodiment of the present invention. As illustrated in FIG. 5, when quantized samples 9, 2, 4, and 0 are mapped on a bitplane, they are expressed in binary form, i.e., 1001b, 0010b, 0100b, and 0000b, respectively. Here, in this brief example, the size of a coding block as the coding unit on a bitplane is 4×4. A set of bits in the same order for each of the quantized samples is referred to as a symbol. A symbol formed with the most significant bits MSB is "1000b", a symbol formed with the next significant bits MSB-1, is "0010b", a symbol formed with the following next significant bits MSB-2 is "0100b", and a symbol formed the least significant bits MSB-3, is "1000b".

Referring back to FIG. 4, in operation 32, the context representing various symbols of an upper bitplane located above a current bitplane to be coded is determined. Here, the term context means a symbol of the upper bitplane which is necessary for encoding.

Again, in operation 32, the context that represents symbols which have binary data having three "1"s or more among the various symbols of an upper bitplane is determined as a representative symbol of the upper bitplane for encoding. For example, when 4-bit binary data of the representative symbol of the upper bitplane is one of "0111", "1011", "1101", "1110", and "1111", it can be seen that the number of "1"s in the symbols is greater than or equal to 3. In this case, a symbol that represents symbols which have binary data having three "1"s or more among the various symbols of the upper bitplane is determined to be the context.

Alternatively, the context that represents symbols which have binary data having two "1"s among the symbols of the upper bitplane may be determined as a representative symbol of the upper bitplane for encoding. For example, when 4-bit binary data of the representative symbol of the upper bitplane is one of "0011", "0101", "0110", "1001", "1010", and "1100", it can be seen that the number of "1"s in the symbols is equal to 2. In this case, a symbol that represents symbols which have binary data having two "1"s among the various symbols of the upper bitplane is determined to be the context.

Alternatively, the context that represents symbols which have binary data having one "1" among the symbols of the upper bitplane may be determined as a representative symbol of the upper bitplane for encoding. For example, when 4-bit binary data of the representative symbol of the upper bitplane is one of "0001", "0010", "0100", and "1000", it can be seen that the number of "1"s in the symbols is equal to 1. In this case, a symbol that represents symbols which have binary data having one "1" among the various symbols of the upper bitplane is determined to be the context.

FIG. 6 illustrates a context for explaining an operation of determining a context, such as discussed regarding FIG. 4, according to an embodiment of the present invention. In "Process 1" of FIG. 6, one of "0111", "1011", "1101", "1110", and "1111" is determined to be the context that represents symbols which have binary data having three "1"s or more. In "Process 2" of FIG. 6, one of "0011", "0101", "0110", "1001", "1010", and "1100" is determined to be the context that represents symbols which have binary data having two "1"s, and one of "0111", "1011", "1101", "1110", and "1111" is determined to be the context that represents symbols which have binary data having three "1"s or more. Conventionally, a codebook must be generated for each symbol of the upper bitplane. In other words, when a symbol is composed of 4 bits, it has to be divided into 16 types. However, according an embodiment of the present invention, once a context that represents symbols of an upper bitplane is determined after "Process 2" of FIG. 6, the size of a required codebook can be reduced because the available symbols may be divided into only 7 types, for example.

As an example of a pseudo code for such coding, FIG. 7 illustrates a pseudo code for Huffman coding with respect to an audio signal, showing an example code for determining a context that represents a plurality of symbols of the upper bitplane using "upper_vector_mapping( )," noting that alternative embodiments are equally available.

Returning to FIG. 4, in operation 34, the symbols of the current bitplane may be encoded using the determined context.

In particular, as an example, Huffman coding can be performed on the symbols of the current bitplane using the determined context.

Such a Huffman model information for Huffman coding, i.e., a codebook index, can be seen in the below Table 1.

TABLE 1

| Additional Information | Significance | Huffman Model |
|---|---|---|
| 0 | 0 | 0 |
| 1 | 1 | 1 |
| 2 | 1 | 2 |
| 3 | 2 | 3 |
| | | 4 |
| 4 | 2 | 5 |
| | | 6 |
| 5 | 3 | 7 |
| | | 8 |
| | | 9 |
| 6 | 3 | 10 |
| | | 11 |
| | | 12 |
| 7 | 4 | 13 |
| | | 14 |
| | | 15 |
| | | 16 |
| 8 | 4 | 17 |
| | | 18 |
| | | 19 |
| | | 20 |
| 9 | 5 | * |
| 10 | 6 | * |
| 11 | 7 | * |
| 12 | 8 | * |
| 13 | 9 | * |
| 14 | 10 | * |
| 15 | 11 | * |
| 16 | 12 | * |
| 17 | 13 | * |
| 18 | 14 | * |
| * | * | * |

According to Table 1, two models exist even for an identical significance level (e.g., the most significant bit no. in the current embodiment). This is because two models are generated for quantized samples that show different distributions.

A process of encoding the example of FIG. 5, according to Table 1, will now be described in greater detail.

According to this example, when the number of bits of a symbol is less than 4, Huffman coding, in this embodiment, may be accomplished according to the below Equation 1.

$$\text{Huffman code value}=\text{HuffmanCodebook}[\text{codebook index}][\text{upper bitplane}][\text{symbol}] \quad \text{Equation 1}$$

In other words, Huffman coding uses a codebook index, an upper bitplane, and a symbol as 3 input variables. The codebook index indicates a value obtained from Table 1, for example, the upper bitplane indicates a symbol immediately above a symbol to be currently coded on a bitplane, and the symbol indicates a symbol to be currently coded. The context determined in operation 32 can thus be input as a symbol of the upper bitplane. Here, the symbol means binary data of the current bitplane to be currently coded.

Since the significance level in the example of FIG. 5 is 4, Huffman models 13-16 or 17-20 may be selected. Thus, if the aforementioned additional information to be coded is 7, the codebook index of a symbol formed with MSB is 16, the codebook index of a symbol formed with MSB-1 is 15, the codebook index of a symbol formed with MSB-2 is 14, and the codebook index of a symbol formed with MSB-3 is 13.

In the example of FIG. 5, since the symbol formed with MSB does not have data of an upper bitplane, if the value of the upper bitplane is 0, coding is performed with a code HuffmanCodebook[16][0b][1000b], for example. Since the upper bitplane of the symbol formed with MSB-1 is 1000b, coding is performed with a code HuffmanCodebook[15]

[1000b][0010b]. Likewise, since the upper bitplane of the symbol formed with MSB-2 is 0010b, coding is performed with a code HuffmanCodebook[14][0010b][0100b], and since the upper bitplane of the symbol formed with MSB-3 is 0100b, coding is performed with a code HuffmanCodebook [13][0100b][1000b].

After coding in units of symbols, the number of encoded bits may be counted and the counted number compared with the number of bits allowed to be used in a layer. If the counted number is greater than the allowed number, the coding may be stopped. The remaining bits that are not coded may then be coded and put in the next layer, if room is available in the next layer. If there is still room in the number of allowed bits in the layer after quantized samples allocated to a layer are all coded, i.e., if there is room in the layer, quantized samples that have not been coded after coding in the lower layer is completed may also be coded.

If the number of bits of a symbol formed with MSB is greater than or equal to 5, a Huffman code value may be determined using a location on the current bitplane. In other words, if the significance is greater than or equal to 5, there is little statistical difference in data on each bitplane, the data may be Huffman-coded using the same Huffman model. In other words, a Huffman mode exists per bitplane.

If the significance is greater than or equal to 5, i.e., the number of bits of a symbol is greater than or equal to 5, Huffman coding, according to the present invention, may be implemented according to the below Equation 2.

$$\text{Huffman code}=20+\text{bpl} \qquad \text{Equation 2}$$

Here, bpl indicates an index of a bitplane to be currently coded and is an integer that is greater than or equal to 1. The constant 20 is a value added for indicating that an index starts from 20 because the last index of Huffman models corresponding to additional information 8 listed in Table 1 is 20. Thus, additional information for a coding band simply indicates significance. In the below Table 2, Huffman models are determined according to the index of a bitplane to be currently coded.

TABLE 2

| Additional Information | Significance | Huffman Model |
|---|---|---|
| 9 | 5 | 21-25 |
| 10 | 6 | 21-26 |
| 11 | 7 | 21-27 |
| 12 | 8 | 21-28 |
| 13 | 9 | 21-29 |
| 14 | 10 | 21-30 |
| 15 | 11 | 21-31 |
| 16 | 12 | 21-32 |
| 17 | 13 | 21-33 |
| 18 | 14 | 21-34 |
| 19 | 15 | 21-35 |

For quantization factor information and Huffman model information in additional information. DPCM may be performed on a coding band corresponding to the information. When the quantization factor is coded, the initial value of DPCM may be expressed by 8 bits in the header information of a frame. The initial value of DPCM for Huffman model information can be set to 0.

In order to control a bitrate, i.e., in order to apply scalability, a bitstream corresponding to one frame may be cut off based on the number of bits allowed to be used in each layer such that decoding can be performed only with a small amount of data.

Arithmetic coding may be performed on symbols of the current bitplane using the determined context. For arithmetic coding, a probability table instead of a codebook may be used. At this time, a codebook index and the determined context are also used for the probability table and the probability table may be expressed in the form of ArithmeticFrequencyTable [ ][ ][ ], for example. Input variables in each dimension may be the same as in Huffman coding and the probability table shows a probability that a given symbol is generated. For example, when a value of ArithmeticFrequencyTable [3][0][1] is 0.5, it means that the probability that a symbol 1 is generated when a codebook index is 3 and a context is 0 is 0.5. Generally, the probability table is expressed with an integer by being multiplied by a predetermined value for a fixed point operation.

Hereinafter, a method of decoding an audio signal, according to an embodiment of the present invention, will be described in greater detail with reference to FIGS. 8 and 9.

Figure 8:
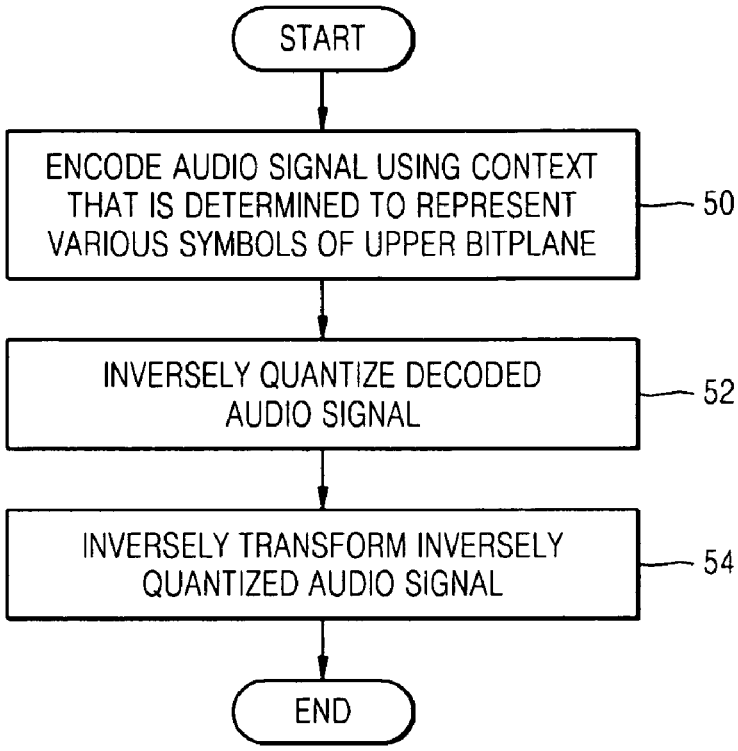
FIG. 8 illustrates a method of decoding an audio signal, according to an embodiment of the present invention.

FIG. 8 illustrating a method of decoding an audio signal, according to an embodiment of the present invention.

When a bitplane encoded audio signal is decoded, it can be decoded using a context that is determined to represent various symbols of an upper bitplane, in operation 50.

Figure 9:
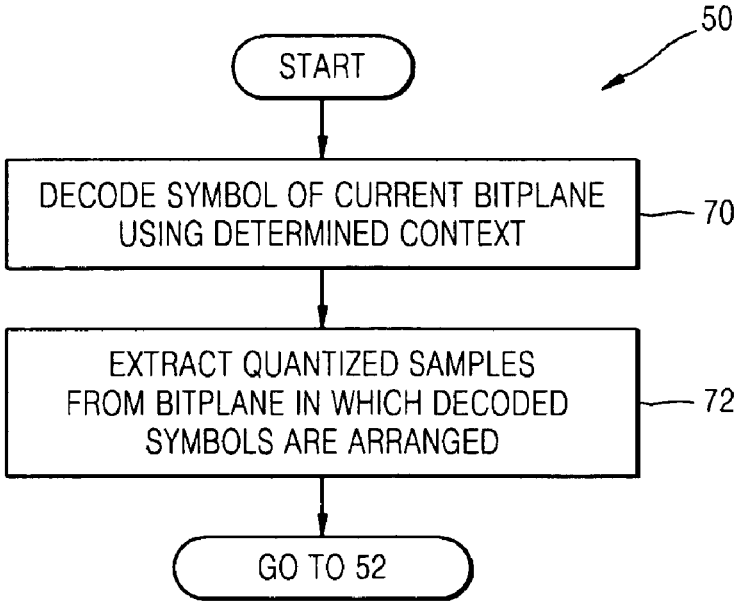
FIG. 9 illustrates an operation of a decoding of an audio signal using a context, such as discussed regarding FIG. 8, according to an embodiment of the present invention.

In regard to this operation 50, FIG. 9 illustrates such an operation in greater detail, according to an embodiment of the present invention.

In operation 70, symbols of the current bitplane may be decoded using the determined context. Here, the encoded bitstream has been encoded using a context that has been determined during encoding. The encoded bitstream including audio data encoded to a hierarchical structure is received and header information included in each frame decoded. Additional information including scale factor information and coding model information corresponding to a first layer may be decoded, and next, decoding may be performed in units of symbols with reference to the coding model information in order from a symbol formed for the most significant bits down to a symbol formed for the least significant bits.

In particular, Huffman decoding may be performed on the audio signal using the determined context. Huffman decoding is an inverse process to Huffman coding described above.

Arithmetic decoding may also be performed on the audio signal using the determined context. Arithmetic decoding is an inverse process to arithmetic coding.

In operation 72, quantized samples may then be extracted from a bitplane in which the decoded symbols are arranged, and quantized samples for each layer obtained.

Returning to FIG. 8, the decoded audio signal may be inversely quantized, with the obtained quantized samples being inversely quantized with reference to the scale factor information.

In operation 54, the inversely quantized audio signal may then be inversely transformed.

Frequency/time mapping is performed on the reconstructed samples to form PCM audio data in the time domain. In one embodiment, inverse transformation according to MDCT is performed.

Hereinafter, an apparatus for encoding an audio signal, according to an embodiment of the present invention, will be described in greater detail with reference to FIGS. 10 and 11.

Figure 10:
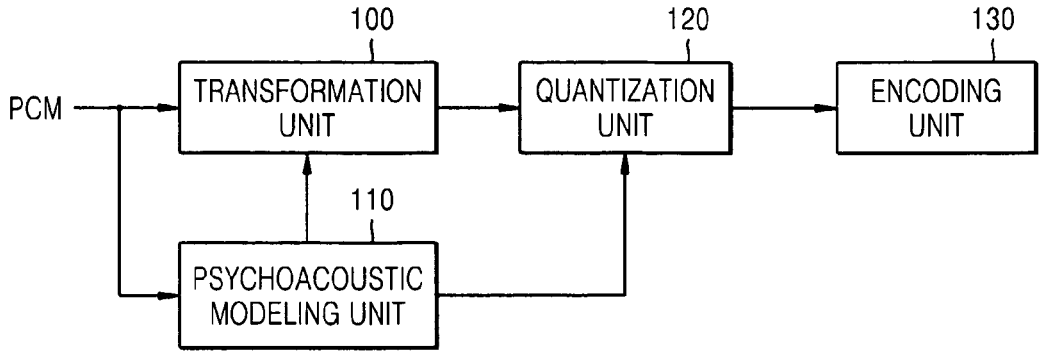
FIG. 10 illustrates an apparatus for encoding an audio signal, according to an embodiment of the present invention.

FIG. 10 illustrates an apparatus for encoding an audio signal, according to an embodiment of the present invention. Referring to FIG. 10, the apparatus may include a transformation unit 100, a psychoacoustic modeling unit 110, a quantization unit 120, and an encoding unit 130, for example.

The transformation unit 100 may transform a pulse coded modulation (PCM) audio data into the frequency-domain, e.g., by referring to information regarding a psychoacoustic model provided by the psychoacoustic modeling unit 110. As noted above, while the difference between characteristics of audio signals that can be perceived is not so large in the time domain, there is a large difference between characteristics of a signal that can be perceived and that which cannot be perceived in each frequency band, e.g., according to the human psychoacoustic model in the frequency-domain audio signals obtained through the frequency domain transformation. Therefore, by allocating different numbers of bits to different frequency bands, compression efficiency can be improved. In one embodiment, the transformation unit 100 may implement a modified discrete cosine transformation (MDCT), for example.

The psychoacoustic modeling unit 110 may provide information regarding a psychoacoustic model, such as attack sensing information, to the transformation unit 100 and group the audio signals transformed by the transformation unit 100 into signals of appropriate sub-bands. The psychoacoustic modeling unit 110 may also calculate a masking threshold in each sub-band, e.g., using a masking effect caused by interactions between signals, and provide the masking thresholds to the quantization unit 120. The masking threshold can be the maximum size of a signal that cannot be perceived due to the interaction between audio signals. In one embodiment, the psychoacoustic modeling unit 110 may calculate masking thresholds for stereo components using binaural masking level depression (BMLD), for example.

The quantization unit 120 may scalar-quantize the frequency domain audio signal in each band based on scale factor information corresponding to the audio signal such that the size of quantization noise in the band is less than the masking threshold, for example, provided by the psychoacoustic modeling unit 110, such that quantization noise cannot be perceived. The quantization unit 120 then outputs the quantized samples. In other words, by using the masking threshold calculated in the psychoacoustic modeling unit 110 and a noise-to-mask ratio (NMR), as the rate of a noise generated in each band, the quantization unit 120 can perform quantization so that NMR values are 0 dB or less, for example, in an entire band. The NMR values of 0 dB or less mean that a quantization noise cannot be perceived.

The encoding unit 130 may then perform coding on the quantized audio signal using a context that represents various symbols of the upper bitplane when the coding is performed using bitplane coding. The encoding unit 130 encodes quantized samples corresponding to each layer and additional information and arranges the encoded audio signal in a hierarchical structure. The additional information in each layer may include scale band information, coding band information, scale factor information, and coding model information, for example. The scale band information and coding band information may be packed as header information and then transmitted to a decoding apparatus, and the scale band information and coding band information may also be encoded and packed as additional information for each layer and then transmitted to a decoding apparatus. In one embodiment, the scale band information and coding band information may not be transmitted to a decoding apparatus because they may be previously stored in the decoding apparatus. More specifically, while coding additional information, including scale factor information and coding model information corresponding to a first layer, the encoding unit 130 may perform encoding in units of symbols in order from a symbol formed with the most significant bits to a symbol formed with the least significant bits by referring to the coding model information corresponding to the first layer. In the second layer, the same process may be repeated. In other words, until the coding of a plurality of predetermined layers is completed, coding can be performed sequentially on the layers.

In the current embodiment of the present invention, the encoding unit 130 may differential-code the scale factor information and the coding model information, and Huffman-code the quantized samples. Scale band information refers to information for performing quantization more appropriately according to frequency characteristics of an audio signal. When a frequency area is divided into a plurality of bands and an appropriate scale factor is allocated to each band, the scale band information indicates a scale band corresponding to each layer. Thus, each layer may be included in at least one scale band. Each scale band may have one allocated scale vector. Coding band information also refers to information for performing quantization more appropriately according to frequency characteristics of an audio signal. When a frequency area is divided into a plurality of bands and an appropriate coding model is assigned to each band, the coding band information indicates a coding band corresponding to each layer. The scale bands and coding bands are empirically divided, and scale factors and coding models corresponding thereto are determined.

Figure 11:
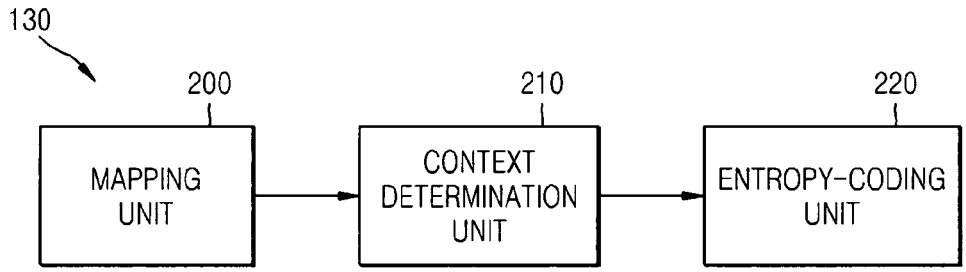
FIG. 11 illustrates an encoding unit, such as illustrated in FIG. 10, according to an embodiment of the present invention.

FIG. 11 illustrates an encoding unit, such as the encoding unit 130 of FIG. 10, according to an embodiment of the present invention. Referring to FIG. 11, the encoding unit 130 may include a mapping unit 200, a context determination unit 210, and an entropy-coding unit 220, for example.

The mapping unit 200 may map the plurality of quantized samples of the quantized audio signal onto a bitplane and output a mapping result to the context determination unit 210. Here, the mapping unit 200 would express the quantized samples as binary data by mapping the quantized samples onto the bitplane.

The context determination unit 210 further determine a context that represents various symbols of an upper bitplane. For example, the context determination unit 210 may determine a context that represents symbols which have binary data having three "1"s or more among the various symbols of the upper bitplane, determine a context that represents symbols which have binary data having two "1"s among the various symbols of the upper bitplane, and determine a context that represents symbols which have binary data having one "1" among the various symbols of the upper bitplane, for example.

In this example, as illustrated in FIG. 6, in "Process 1", one of "0111", "1011", "1101", "1110", and "1111" may be determined to be the context that represents symbols which have binary data having three "1"s or more. In "Process 2", one of "0011", "0101", "0110", "1001", "1010", and "1100" may be determined to be the context that represents symbols which have binary data having two "1"s and one of "0111", "1011", "1101", "1110", and "1111" may be determined to be the context that represents symbols which have binary data having three "1"s or more.

The entropy-coding unit 220 may further perform coding with respect to symbols of the current bitplane using the determined context.

In particular, the entropy-coding unit 220 may perform the aforementioned Huffman coding on the symbols of the current bitplane using the determined context.

Hereinafter, an apparatus for decoding an audio signal will be described in greater detail with reference to FIG. 12.

Figure 12:
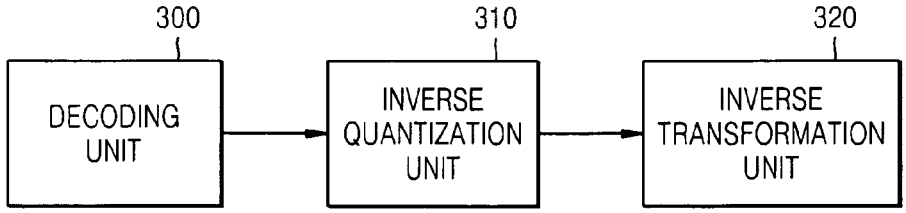
FIG. 12 illustrates an apparatus for decoding an audio signal, according to an embodiment of the present invention.

FIG. 12 illustrates an apparatus for decoding an audio signal, according to an embodiment of the present invention. Referring to FIG. 12, the apparatus may include a decoding unit 300, an inverse quantization unit 310, and an inverse transformation unit 320, for example.

The decoding unit 300 may decode an audio signal that has been encoded using bitplane coding, using a context that has been determined to represent various symbols of an upper bitplane, and output a decoding result to the inverse quantization unit 310. Here, the decoding unit 300 may decode symbols of the current bitplane using the determined context and extract quantized samples from the bitplane in which the decoded symbols are arranged. The audio signal has been encoded using a context that has been determined during encoding. The decoding unit 300, thus, may receive the encoded bitstream including audio data encoded to a hierarchical structure and decode header information included in each frame, and then decode additional information including scale factor information and coding model information corresponding to a first layer. Thereafter, the decoding unit 300 may perform decoding in units of symbols by referring to the coding model information in order from a symbol formed with the most significant bits down to a symbol formed with the least significant bits.

In particular, the decoding unit 300 may perform Huffman decoding on the audio signal using the determined context. As noted above, Huffman decoding is an inverse process to Huffman coding.

The decoding unit 300 may also perform arithmetic decoding on the audio signal using the determined context, with arithmetic decoding being an inverse process to arithmetic coding.

The inverse quantization unit 310 may then perform inverse quantization on the decoded audio signal and output the inverse quantization result to the inverse transformation unit 320. The inverse quantization unit 310 inversely quantizes quantized samples corresponding to each layer according to scale factor information corresponding to the layer for reconstruction.

The inverse transformation unit 320 may further inversely transform the inversely quantized audio signal, e.g., by performing frequency/time mapping on the reconstructed samples to form PCM audio data in the time domain. In one embodiment, the inverse transformation unit 320 performs inverse transformation according to MDCT.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including magnetic storage media (e.g., ROM, floppy disks, hard disks, etc.), optical recording media (e.g., CD-ROMs, or DVDs), and storage/transmission media such as carrier waves, as well as through the Internet, for example. Here, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device. The medium may also correspond to a recording, transmission, and/or reproducing medium that includes audio data with frequency based compression, with separately bitplane encoded frequency based encoded samples including respective additional information controlling decoding of the separately encoded frequency based encoded samples based upon a respective context in the respective additional information representing various available symbols for an upper bitplane other than a current bitplane.

As described above, according to an embodiment of the present invention, when an audio signal is coded using bitplane coding, a context that represents a plurality of symbols of an upper bitplane is used, thereby reducing the size of codebooks that have to be stored in a memory and improving coding efficiency.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of encoding an audio signal, the method comprising:

transforming, using at least one processing device, an audio signal into a frequency-domain audio signal;

quantizing, using the at least one processing device, the frequency-domain audio signal; and performing bitplane coding, using the at least one processing device, on a current bitplane of the quantized audio signal using a context as a representative of various available symbols of an upper bitplane, wherein the various available symbols are grouped, based on the number of "1" included in each of the symbols of the upper bitplane.

2. The method of claim 1, wherein the performing of the coding using the context comprises:

mapping a plurality of quantized samples of the quantized audio signal onto a bitplane;

determining the context from a plurality of contexts according to the representing of the various symbols of the upper bitplane; and performing coding on a symbol of the current bitplane using the determined context.

3. The method of claim 2, wherein the determining of the context comprises determining the context as representing symbols which have binary data having three "1"s or more among the various symbols.

4. The method of claim 2, wherein the determining of the context comprises determining the context as representing symbols which have binary data having two "1"s among the various symbols.

5. The method of claim 2, wherein the determining of the context comprises determining the context as representing symbols which have binary data having one "1" among the various symbols.

6. The method of claim 2, wherein the coding of the symbol of the current bitplane comprises performing Huffman coding on the symbol of the current bitplane using the determined context.

7. The method of claim 2, wherein the coding of the symbol of the current bitplane comprises performing arithmetic coding on the symbol of the current bitplane using the determined context.

8. At least one non-transitory computer-readable storage medium comprising computer readable code to control at least one processing element to implement the method of claim 1.

9. A method of decoding an audio signal, the method comprising:

decoding, using at least one processing device, an encoded current bitplane of a bitplane encoded audio signal using a context that is determined as a representative of various available symbols of an upper bitplane, wherein the various available symbols are grouped, based on the number of "1" included in each of the symbols of the upper bitplane;

inversely quantizing, using the at least one processing device, a corresponding decoded audio signal; and inversely transforming, using the at least one processing device, the inversely quantized audio signal.

10. The method of claim 9, wherein the decoding of the current bitplane audio signal comprises:

decoding a symbol of the current bitplane using the determined context; and extracting a quantized sample from a bitplane in which the decoded symbol is arranged.

11. The method of claim 9, wherein the decoding of the current encoded bitplane comprises performing Huffman decoding on the current encoded bitplane using the determined context.

12. The method of claim 9, wherein the decoding of the current encoded bitplane comprises performing arithmetic decoding on the current encoded bitplane using the determined context.

13. At least one non-transitory computer-readable storage medium comprising computer readable code to control at least one processing element to implement the method of claim 9.

14. An apparatus, including at least one processing device, for encoding an audio signal, the apparatus comprising:

a transformation unit using the processing device to transform an audio signal into a frequency-domain audio signal;

a quantization unit to quantize the frequency-domain audio signal; and an encoding unit to perform bitplane coding on a current bitplane of the quantized audio signal using a context as a representative of various available symbols of an upper bitplane, wherein the various available symbols are grouped, based on the number of "1" included in each of symbols of the upper bitplane.

15. The apparatus of claim 14, wherein the encoding unit comprises:

a mapping unit to map a plurality of quantized samples of the quantized audio signal onto a bitplane;

a context determination unit to determine the context, from a plurality of contexts, according to the representing of the various symbols of the upper bitplane; and an entropy-coding unit to perform coding on a symbol of the current bitplane using the determined context.

16. The apparatus of claim 15, wherein the context determination unit determines the context as representing symbols which have binary data having three "1"s or more among the various symbols.

17. The apparatus of claim 15, wherein the context determination unit determines the context as representing symbols which have binary data having two "1"s among the various symbols.

18. The apparatus of claim 15, wherein the context determination unit determines the context as representing symbols which have binary data having one "1" among the various symbols.

19. The apparatus of claim 15, wherein the entropy-coding unit performs Huffman coding on the symbol of the current bitplane using the determined context.

20. The apparatus of claim 15, wherein the entropy-coding unit performs arithmetic coding on the symbol of the current bitplane using the determined context.

21. At least one non-transitory computer-readable storage medium comprising audio data with frequency based compression, with separately bitplane encoded frequency based encoded samples comprising respective additional information controlling decoding of the separately encoded frequency based encoded samples based upon a respective context in the respective additional information as a representative of various available symbols for an upper bitplane other than a current bitplane, wherein the various available symbols are grouped, based on the number of "1" included in each of symbols of the upper bitplane.

22. An apparatus, including at least one processing device, for decoding an audio signal, the apparatus comprising:

a decoding unit to decode an encoded current bitplane of a bitplane encoded audio signal using a context that is determined as a representative of various available symbols of an upper bitplane, wherein the various available symbols are grouped, based on the number of "1"included in each of symbols of the upper bitplane;

an inverse quantization unit inversely quantizing the decoded audio signal; and an inverse transformation unit using the at least one processing device inversely transforming the inversely quantized audio signal.

23. The apparatus of claim 22, wherein the decoding unit decodes a symbol of the current bitplane using the determined context and extracts a quantized sample from a bitplane in which the decoded symbol is arranged.

24. The apparatus of claim 22, wherein the decoding unit performs Huffman decoding on the current encoded bitplane using the determined context.

25. The apparatus of claim 22, wherein the decoding unit performs arithmetic decoding on the current encoded bitplane using the determined context.

* * * * *

UNITED STATES PATENT AND TRADEMARK OFFICE

CERTIFICATE OF CORRECTION

PATENT NO. : 8,224,658 B2
APPLICATION NO. : 11/634251
DATED : July 17, 2012
INVENTOR(S) : Miao Lei et al.

It is certified that error appears in the above-identified patent and that said Letters Patent is hereby corrected as shown below:

Column 13, Line 6, In Claim 9, after “of” delete “the”.
Column 14, Line 37, In Claim 22, delete ““1”included” and insert -- “1” included --, therefor.

Signed and Sealed this
Twentieth Day of November, 2012

David J. Kappos

David J. Kappos
*Director of the United States Patent and Trademark Office*